US007871472B2

(12) United States Patent
Buser

(10) Patent No.: US 7,871,472 B2
(45) Date of Patent: Jan. 18, 2011

(54) HOUSEHOLD WASHING APPLIANCE WITH BIOCIDE ELEMENT IN A WASH CHAMBER

(75) Inventor: Josef Arnold Buser, Schoenenberg-Kuebelberg (DE)

(73) Assignee: Whirlpool Corporation, Benton Harbor, MI (US)

( * ) Notice: Subject to any disclaimer, the term of this patent is extended or adjusted under 35 U.S.C. 154(b) by 138 days.

(21) Appl. No.: 11/850,909

(22) Filed: Sep. 6, 2007

(65) Prior Publication Data

US 2008/0060690 A1 Mar. 13, 2008

(30) Foreign Application Priority Data

Sep. 8, 2006 (EP) ..... 06120394

(51) Int. Cl.
*B08B 3/04* (2006.01)

(52) U.S. Cl. ..... 134/56 D; 134/57 D; 134/58 D; 134/99.2; 134/109

(58) Field of Classification Search ..... 134/56 D, 134/115 R, 58 D, 57 D, 99.2, 109, 110
See application file for complete search history.

(56) References Cited

FOREIGN PATENT DOCUMENTS

| | | | |
|---|---|---|---|
| EP | 1415585 | A1 | 5/2004 |
| EP | 1550396 | A2 * | 7/2005 |
| JP | 05111451 | A | 5/1993 |
| JP | 6023191 | A2 | 2/1994 |
| JP | 9182893 | A2 | 7/1997 |
| KR | 20050065718 | A | 12/2003 |
| WO | WO 03099096 | A1 * | 12/2003 |

OTHER PUBLICATIONS

Machine Translation of Korean Patent Application 1020050065718 to Lee, Jun. 2005.*

* cited by examiner

*Primary Examiner*—Joseph L Perrin
*Assistant Examiner*—Benjamin Osterhout
(74) *Attorney, Agent, or Firm*—Robert A. Bacon; McGarry Bair PC

(57) ABSTRACT

A household washing appliance having a wash chamber with a sump region at the bottom is disclosed. The sump region is in communication with a filter housed in a filter chamber is disclosed. The appliance further includes a biocide element in communication with the wash chamber. The wash chamber operatively receives wash liquid from a wash pump downstream of the filter.

12 Claims, 2 Drawing Sheets

HOUSEHOLD WASHING APPLIANCE WITH BIOCIDE ELEMENT IN A WASH CHAMBER

BACKGROUND OF THE INVENTION

1. Field of the Invention

The present invention relates to a household washing appliance with a biocide element in a wash chamber. The invention relates to a dishwasher with a removable biocide element housed within the filter of the dishwasher.

2. Description of the Related Art

EP-A-1 415 585 discloses a dishwasher with a soundproofing structure comprising membranes or nets located near the inner walls of the washing chamber to disperse wash water under pressure that hits the walls of the wash chamber, thereby reducing the noise. These nets may be coated with an antibacterial material to prevent propagation of bacteria on the net and fouling of the same.

JP 06023191 A2 discloses household electrical appliances having a resistance to bacteria and fungi achieved by applying onto the surfaces of the appliance finish layers of enameled porcelain containing silver and/or copper and/or zinc.

JP 09182893 A2 discloses a washing machine wherein the casing of the pump consists of a synthetic resin containing an antibacterial agent which improves resistance to bacteria.

There are several disadvantages to, or problems not solved by, the household appliances disclosed in the prior art documents mentioned above. These documents disclose household appliances designed to acquire a resistance to the growth and the formation of colonies of harmful or undesired microorganisms on certain components or parts of the appliance only. Typically, these components or parts are treated or coated with anti-bacterial agents that are built-in during the manufacturing process of the appliance. This means that: a) such anti-bacterial agents are designed to prevent formation of bacterial colonies solely or mainly on those parts where they are applied; and b) the anti-bacterial agents are intended to be permanently effective, which is hardly possible due to a consumption of the anti-bacterial active substances during the life-cycle of the appliance.

There thus exists a need in household washing appliances both for an anti-bacterial treatment which effectiveness is not limited to a component or part of the appliance, and that can be effective for the entire life-cycle of the washing appliance, or at least for a portion thereof allowing an easy replacement of the biocide element.

SUMMARY OF THE INVENTION

One aspect of the present invention is to disclose an improved household washing appliance capable of preventing or limiting the growth of harmful or undesired micro organisms in all those components or parts that are in contact with the wash water.

Another aspect of the present invention is to disclose an improved household washing appliance capable of preventing or limiting the growth of microorganisms over an unlimited or well-defined period of time.

An additional aspect of the present invention is to disclose an improved household-washing appliance capable of exerting a disinfectant action on the wash liquid itself.

A further aspect of the present invention is to disclose an improved household washing appliance capable of exerting a disinfectant action without significant increase of the manufacturing cost.

The aforesaid and other aspects of the invention, as it will appear from the following description, are achieved by an improved household washing appliance comprising a wash chamber with a sump region at the bottom in communication with a filter housed in a filter chamber, the wash chamber receiving wash liquid from a wash pump downstream the filter, characterised by biocide located in the wash chamber. The biocide is located in the filter chamber located in the wash chamber.

According to another aspect of the invention, the biocide comprises a detachable element that can be replaced by a user of the appliance.

According to a further aspect of the invention, the detachable biocide element is located within the filter and wash liquid flows through the filter.

According to a further aspect of the invention, the biocide element comprises a biocide composition supported on an inert carrier.

According to a second embodiment of the invention, the biocide is embedded in the filter.

BRIEF DESCRIPTION OF THE DRAWINGS

Some embodiments of the invention will now be described by way of example with reference to the attached drawings, wherein.

DETAILED DESCRIPTION OF THE PREFERRED EMBODIMENTS

Figure 1:
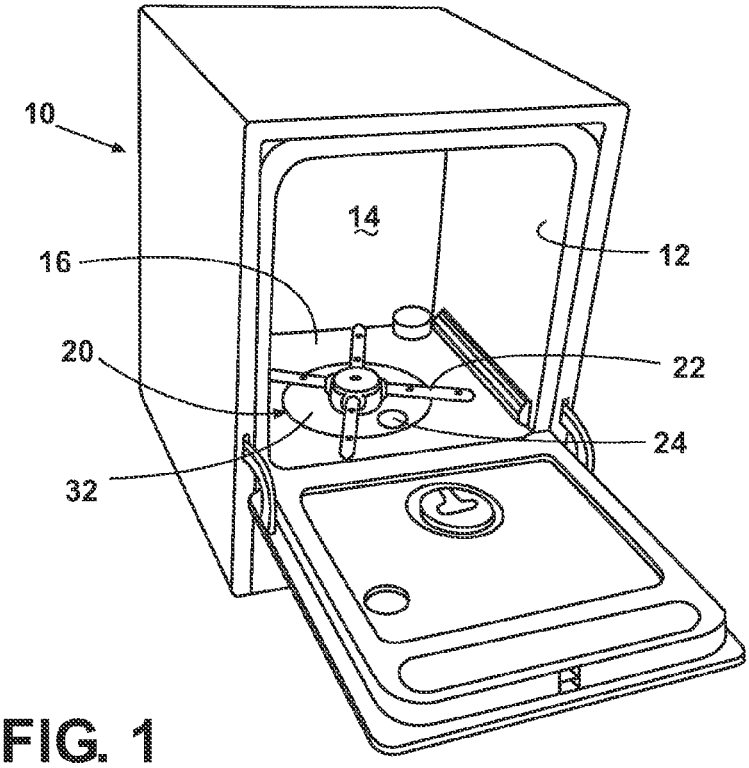
FIG. 1 is a perspective view of a dishwasher including a sump region connected to filter, not shown.
Figure 2:
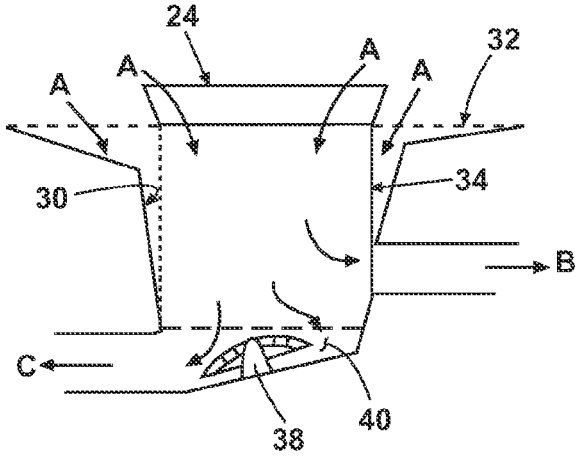
FIG. 2 is a schematic cross-sectional view of a filtering chamber of a dishwasher with biocide according to the invention.

With reference to FIG. 1, a dishwasher generally designated with 10 comprises an interior tub 12 defining an interior wash chamber 14. Tub 12 includes a sloped bottom 16 defining a sump region in which a coarse particle grate 24 is located. This grate 24 is part of a soil separator and pump assembly 20 equipped with spray arms 22, known in the art. Grate 24 permits wash liquid to flow from the wash chamber 14 to a filter chamber 30 located below grate 24, as shown in FIG. 2, and prevents large items from entering the filter chamber. Filter chamber 30, which is a defined portion of the wash chamber 14, houses a filter comprising an upper sieve wall 32 and a fine particle filter 34, of a cylindrical shape. The wash liquid is sucked by a pump not shown located downstream the filter chamber, and enters the filter chamber through grate 24 and upper sieve wall 32, as indicated by arrows A. Part of the wash liquid flows into the fine particles filter 34, so that after a certain number of pumping cycles the entire wash liquid undergoes a fine filtration. During washing operation the filtered liquid is pumped by a washing pump not shown in the direction of arrow B and is circulated back to the wash chamber 14. After a washing operation the filtered liquid is pumped by a drain pump not shown in the direction of arrow C and is discharged outside the washing appliance.

Figure 3:
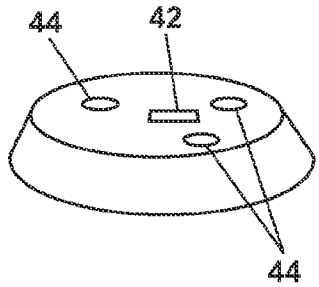
FIG. 3 is a schematic enlarged perspective view of an embodiment of biocide according to the invention.

A biocide element 40 is detachably mounted on a support 38 projecting from the bottom of the filter chamber. In a preferred embodiment of the invention biocide element 40 is cup-shaped, as shown also in FIG. 3. A central rectangular hole 42 is provided in biocide element 40 to allow a forcible mounting on the tip of support 38, with the convex back surface of the cup exposed to the direction of flow of the wash liquid. Holes 44 are also provided in element 40 to let the wash liquid flow there through. The cup-shaped biocide element 40 is mounted on support 38 in a way that it is spaced apart from the walls of filter 34 and the bottom of the filter chamber 30, thereby allowing a maximum contact of the wash liquid with the surface of element 40.

Biocide element 40 comprises one or more chemical compounds or element having a biocide and disinfectant effect against bacteria, fungi, viruses or harmful micro organisms in general, thereby preventing the formation and growth of colonies of micro organisms in any part of the washing appliance reached by wash liquid that has been in contact with the biocide element. For example, biocide element 40 can comprise a concentrate of zinc and or silver in metal or ionic form supported on a suitable support such as glass, silica, alumina or a polymeric carrier, including any synthetic resin which is stable at the temperature of the washing operation. Colloidal silver is a powerful disinfectant and germicidal agent capable to disable the enzyme that many bacteria, fungi and viruses use for their metabolism.

Biocide element 40 can be formulated as a slow release biocide composition, so that the antimicrobial and anti-fungi action is extended over the time.

Biocide element 40 can be designed as a removable piece. In this case the location of the same in the filter chamber—a chamber accessible to users of the washing appliance for cleaning and/or replacing the filter—allows replacing the biocide element, if necessary. Also, the location of the biocide element in the filter chamber of the washing appliance—a place where wash liquid is forced to flow during operation of the washing pump—is such that the disinfectant action is exerted effectively on the wash liquid itself. The dishwasher is advantageously provided with a special function alerting the user when the biocide element is no longer active, so that he/she is informed (for instance by a dedicated part or display of the user interface) that it is time to replace the element. This function is managed by the central process unit (CPU) of the dishwasher which stores a total working time of the machine after which the biocide element is considered no longer active. By simply comparing the total actual working time of the machine with such value stored in the CPU the machine is able to alert the user at the right time.

The biocide material can be also integrated with the filter itself, either with the upper sieve or with the fine particle filter or both. In this case the material of the filter, particularly of the sieve thereof, can be stainless steel treated by a known antibacterial treatment, or it can be polymeric material embedding a biocide agent, as known for instance from Microban polymeric materials with biocide properties.

As an alternative embodiment (not shown in the drawings), all the bottom portion of the wash chamber 12 may be made of a polymeric material embedding a biocide substance; in this case the amount of biocide substance is enough for providing a biocide effect for the entire life of the appliance. Even if it could be possible to build all the wash chamber with walls made of a material having biocide properties, tests carried out by the applicant has shown that the overall cost increase is not balanced by a corresponding increase in biocide overall effect. This seems to be due to the reduced contact time between the wash liquor and the side and upper walls of the wash chamber, while the bottom wall of the wash chamber (as well as the filter contained therein) is in contact with the wash liquor for almost the entire duration of the washing program.

Figure 4:
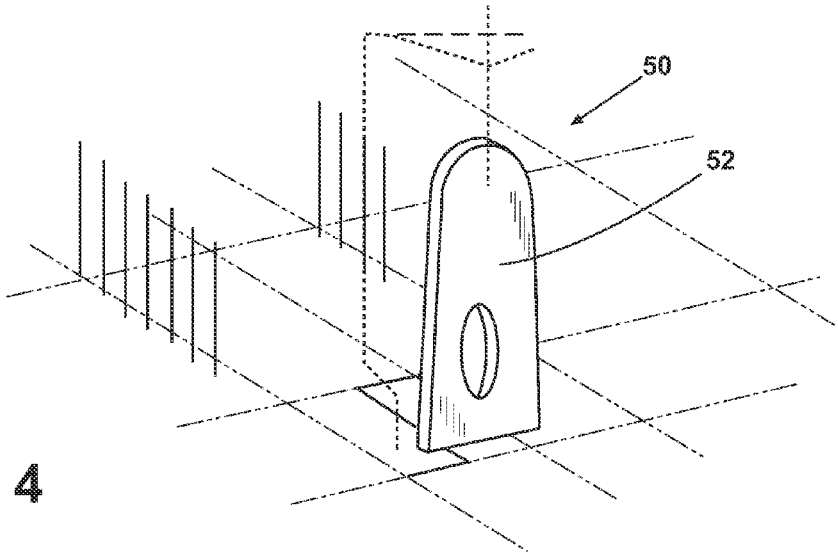
FIG. 4 is a perspective view of a portion of a dishwasher according to a further embodiment of the invention.

According to the embodiment shown in FIG. 4, the lower rack of the dishwasher, indicated with reference 50, can be provided with a removable portion 52 of biocide material having also the function of bottle holder. The portion 52 can be easily removed and replaced on the rack.

Figure 5:
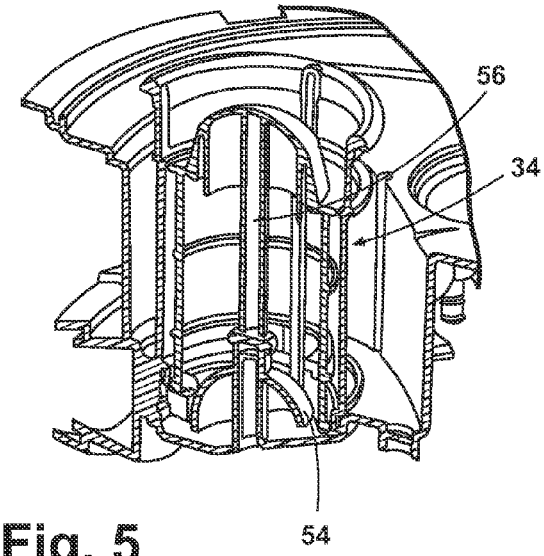
FIG. 5 is a perspective view of a detail of a dishwasher according to another embodiment of the invention.

According to the embodiment shown in FIG. 5, the biocide element can be realised as a bell 54 sliding vertically on a central pin 56 of the fine particle filter 34. In this way, by removing the filter 34 also the bell-shaped biocide element 54 can be easily removed and replaced.

Figure 6:
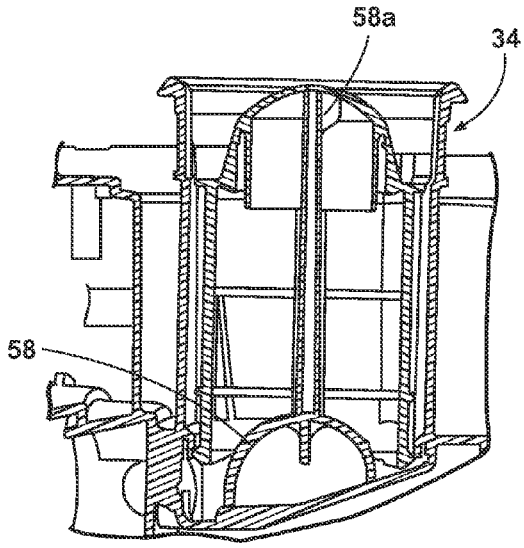
FIG. 6 is a perspective view of a detail of a dishwasher according to another embodiment of the invention.

The embodiment shown in FIG. 6 is quite similar to the one shown in FIG. 5, with the difference that the bell-shaped biocide element 58 is not removed with the filter 34, rather it has an elongated central handle 58*a* for its easy handling.

It is clear from the description above and appended claims that other embodiments of the present invention are possible.

I claim:

1. A household washing appliance comprising:

a wash chamber having a bottom wall;

a sump located on the bottom wall and having a filter chamber;

a sieve wall mounted to the sump above the filter chamber and having an opening aligned with the filter chamber;

a fine filter defining a hollow interior detachably mounted in the filter chamber for insertion and removal through the opening of the sieve wall and in fluid communication with the wash chamber;

a biocide support located within the hollow interior and carried by the fine filter and configured to replaceably support a biocide element;

a biocide element supported by said biocide support;

a wash pump downstream of and fluidly coupled to the filter chamber and fluidly coupled to the wash chamber; and wherein operation of the pump draws fluid from the wash chamber and through the filter chamber where the fluid passes over the biocide element within the hollow interior when the fine filter is mounted within the filter chamber.

2. The household washing appliance according to claim 1, wherein the biocide element is cup-shaped and is mounted with a convex surface facing a direction of flow of the fluid.

3. The household washing appliance according to claim 2, wherein the biocide support is inert.

4. The household washing appliance according to claim 1, wherein the biocide element is provided with holes for the passing of fluid.

5. The household washing appliance according to claim 1, wherein the biocide element comprises one or more of silver, zinc, or derivatives thereof.

6. The household washing appliance according to claim 1, further comprising:

a sensor which generates a biocide level signal; and an electronic control unit capable of receiving the biocide level signal and alerting a user when the biocide element is no longer active.

7. The household washing appliance according to claim 1, wherein the biocide element is a polymeric material with a biocide additive.

8. The household washing appliance according to claim 1 wherein the biocide support is a central pin located in the hollow interior of the fine filter.

9. The household washing appliance according to claim 8 wherein the biocide support is configured to receive a biocide element in the form of a bell that is vertically movable relative to the central pin.

10. The household washing appliance according to claim 1 wherein the fine filter is cylindrical.

11. The household washing appliance according to claim 1 wherein removal of the fine filter from the filter chamber provides access to the biocide element for replacement of the biocide element.

12. A household washing appliance comprising:

a wash chamber having a bottom wall;

a sump located on the bottom wall and having a filter chamber;

a sieve wall mounted to the sump above the filter chamber and having an opening aligned with the filter chamber;

a fine filter defining a hollow interior detachably mounted in the filter chamber for insertion and removal through the opening of the sieve wall and in fluid communication with the wash chamber;

a biocide support located within the hollow interior and carried by the fine filter and configured to replaceably support a biocide element;

a biocide element supported by said biocide support;

a course particle grate projecting from the fine filter and extending above the sieve wall;

a wash pump downstream of and fluidly coupled to the filter chamber and fluidly coupled to the wash chamber; and wherein operation of the pump draws fluid from the wash chamber and through the filter chamber where the fluid passes over the biocide element within the hollow interior when the fine filter is mounted within the filter chamber.

* * * * *